US006085813A

United States Patent [19]

Elliott et al.

[11] Patent Number: 6,085,813

[45] Date of Patent: Jul. 11, 2000

[54] METHOD FOR MAKING PLYWOOD

[75] Inventors: Gary E. Elliott, Monroe; Steve R. Bailey, Eugene; David W. Cooper; Aaro John Campy, both of Junction City, all of Oreg.

[73] Assignee: Georgia-Pacific Corporation, Atlanta, Ga.

[21] Appl. No.: 09/182,223

[22] Filed: Oct. 30, 1998

[51] Int. Cl.[7] ..... B27D 7/00

[52] U.S. Cl. ..... 144/344; 144/346; 144/356; 144/399; 144/242.1; 144/245.2; 156/363; 156/556; 156/559; 156/563; 198/448; 414/789.6; 414/794.4; 428/106

[58] Field of Search ..... 144/344, 345, 144/346, 348, 356, 399, 242.1, 245.2, 245.4; 156/330, 335, 358, 363, 556, 558, 559, 563, 566, 578; 414/788.1, 789.6, 794.4, 794.7; 428/106, 114; 198/448

[56] References Cited

U.S. PATENT DOCUMENTS 3,616,090 10/1971 Larson .
3,620,887 11/1971 Nelson .
3,725,183 4/1973 Brookhyser et al. .
3,785,508 1/1974 Hayden .
4,144,112 3/1979 Hasegawa .
4,243,465 1/1981 Gozzi .
4,316,758 2/1982 Suzuki et al. .
4,342,615 8/1982 Koch, II .
4,541,880 9/1985 Arena et al. .
4,687,035 8/1987 Kuper et al. .
4,797,169 1/1989 Aizawa et al. .
5,071,688 12/1991 Hoffman .
5,665,197 9/1997 Fujii et al. .

*Primary Examiner*—W. Donald Bray
*Attorney, Agent, or Firm*—Banner & Witcoff, Ltd.

[57] ABSTRACT

A method for making hardwood or decorative plywood. The plywood includes a number plies including a back veneer, a face veneer, and a number of core and center plies. The method forms subunits of plies and stacks the discrete formed subunits to form a unit. The unit is processed to forms discrete hardwood panels. Subunits having different sets of plies are formed. The subunits are formed by sequencing the order of placement of the plies so that the face and back veneers do not touch the conveyor. This process enables line assembly of hardwood plywood. Without this sequencing, at least the back veneers would touch the conveyor subjecting the panel to aesthetic damage due to the nature of the outer veneers. This process also significantly reduced the labor necessary for forming the panels because numerous subunits can be formed simultaneously.

20 Claims, 7 Drawing Sheets

METHOD FOR MAKING PLYWOOD

FIELD OF THE INVENTION

This invention relates to a methods for making plywood. This invention is particularly advantageous for making hardwood or decorative plywood. The methods include conveying and sequencing the plies of the plywood in a manner such that automated line assembly is possible.

BACKGROUND OF THE INVENTION

The invention is directed to a method of making hardwood plywood, which is also known as decorative plywood. These terms are used interchangeably herein. Hardwood plywood is different from structural plywood. These differences have led to different manufacturing techniques for each type of plywood.

Both structural and hardwood plywood include a number of plies layered in a superimposed relationship. The direction of the grain of the wood in each internal ply runs transverse to that of the adjacent internal plies to give the panels significant lateral and longitudinal strength. However, structural plywood is used primarily for construction. Structural plywood commonly includes 4–7 plies. Its exterior or back and face plies, known as veneers, are rough sanded. The thicknesses of the back and face plies are not significantly different from the thicknesses of the internal plies. Scratches, defects and other minor errors in the back and face plies of structural plywood are typically not a significant concern because these structural plywood panels are normally used in application that are hidden in use.

In contrast, hardwood plywood must be aesthetically pleasing because it is visible in use, and is frequently used for the decor of a house or building. For example, hardwood plywood is used in cabinets, doors, and other articles. Due to its exposure, hardwood plywood must be essentially aesthetically perfect. As a result, panels having scratches, stains, or other minor imperfections are frequently considered to be defective. Beyond its appearance, hardwood plywood must also be strong and durable.

The primary structural difference between structural plywood and decorative plywood is in the face and back plies, the veneers. An example of a 5-ply hardwood panel 2 is illustrated in FIG. 1. The hardwood panel 2 includes a face veneer 4, a back veneer 10, and alternating core plies 6 and center plies 8. The face and back veneers 4 and 10 in hardwood plywood typically have a thickness in the range between 1/28–1/42 inch. These veneers are thin because of the cost associated with the type of woods used. The face and back veneers are usually made of oak, birch, maple, or other hardwoods.

The methods of manufacturing structural and hardwood plywood are also different. For example, structural plywood is significantly automated and is usually accomplished in a line process. In such an automated line process, the piece of veneer that will become the back of the panel is placed onto a conveyer and travels past additional stations. At each station, internal plies, referred to as core and center plies, are alternately added until a face ply is placed as the last layer of the panel. These superimposed plies are accumulated in some fashion to make a unit comprising of a number of panels. Most automated structural plywood assembly methods utilize sprayable resins, usually a phenol based product, for bonding adjacent plies together.

In contrast, the assembly of hardwood plywood has been much more labor intensive. Hardwood plywood frequently comes in 3, 5, and 7 ply panels. A back veneer panel is placed down. An internal ply, either a center or core ply, is placed on top of the back veneer. Subsequent internal plies are placed on top of a previous internal ply. The assembling and stacking of these plies are done by hand. The face veneer is placed on top of the uppermost internal ply and becomes the top of the panel. As previously discussed, the grain of the wood in each internal ply runs transverse to the internal plies immediately adjacent to it. Alternate internal plies, either the centers or the cores, are run through a standard glue spreader that applies glue to both sides. This process continues until a unit comprised of a number of stacked panels is formed. This unit is taken to a cold prepress and then a hot press so that the plies of the panels can be compressed and the glue can harden. This labor intensive process is also undesirable because it is time consuming. For example, it commonly takes 10–15 minutes to assemble a unit of 30 7-ply panels.

The automated line processing used in structural plywood has not been used for making hardwood plywood because of the thickness, and the fragile and aesthetic nature of the face and back veneers. Another reason that the automated line processing techniques are not used for hardwood plywood is that most hardwood veneers will oxidize and stain if placed in contact with metals and moisture. Yet another reason that automated assembly of hardwood plywood is not used is because phenol based resins, normally used in automated plywood processing, are unsuited for hardwood plywood production because of the tendency of the product to bleed through and oxidize defacing the veneers. The back veneers are not durable enough to carry the other layers in a similar fashion without damage, or by stains from oxidation or excess glue. Any or all of these problems can cause stains or other imperfections on the hardwood veneers which make the panels aesthetically defective and cause them to fall below the needed quality standards.

Therefore, a method of manufacturing hardwood plywood was thus needed which would reduce assembly cost through the reduction of time and labor. The present invention was developed to accomplish these and other objectives.

SUMMARY OF THE INVENTION

This process is used at our facility on our prototype line to lay up a variety of panels including three, five and seven ply panels.

Using the concept of laying only partial panels on the first and last cycles allows us to solve the problem of the backs traveling down the line and being exposed to damage.

In view of the foregoing, the present invention is directed to a method for making hardwood plywood panels having at least one outer hardwood veneer with a thickness no greater than 1/28 inch. The method includes providing a conveyor having a length and a plurality of ply depositing stations longitudinally spaced along the length of the conveyor. Plies from the ply depositing stations are sequentially deposited on the conveyor in a superimposed relationship to form discrete subunits. The discrete subunits are stacked to form a unit. The unit is processed by in any manner to form stacked discrete hardwood plywood panels.

The present invention provides a method of making a unit of wood plies for forming a plurality of discrete plywood panels having a face and back veneers and center and core plies. A first subunit of plies is formed. A plurality of discrete second subunits of plies are formed, each second unit of plies being different from the first subunit. A formed second subunit is stacked on a formed first subunit.

The present invention is also directed to a method of making a unit of wood plies for forming discrete hardwood plywood panels, each having face and back veneers, and center and core plies. The method includes the steps of forming a plurality of subunits, and stacking formed subunits on top of other subunits in a superimposed relationship. At least one of the discrete subunits is formed by: stacking a face veneer on top of one core ply, stacking a back veneer on top of the face veneer, and stacking a second core ply on top of the back veneer.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENT

Figure 1:
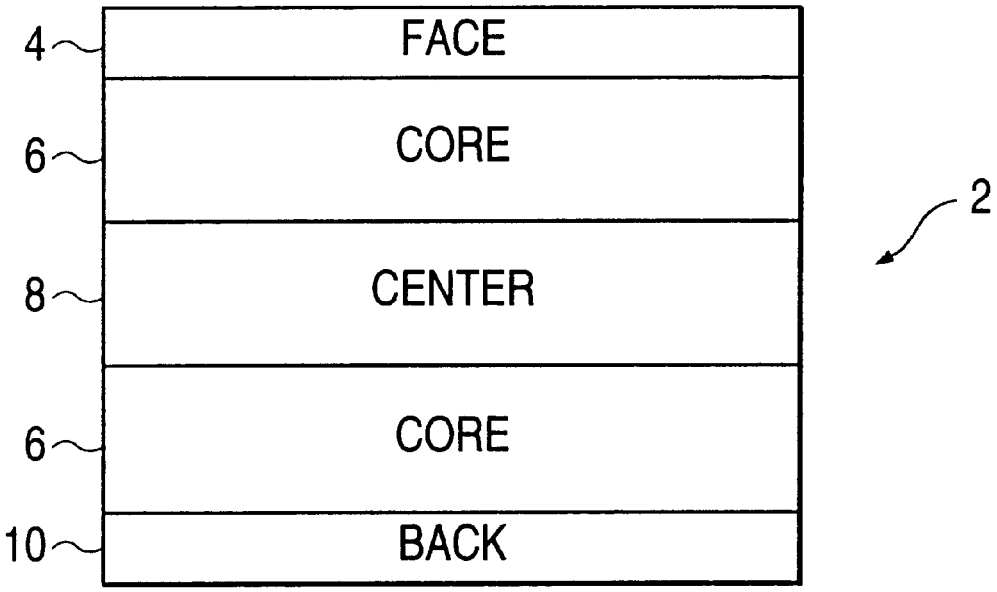
FIG. 1 (PRIOR ART)
FIG. 1 is a schematic depiction of the ordering of the plies of a plywood panel common to the prior art and the present invention.

Referring to the drawings wherein like numerals indicate like elements, an embodiment of an assembly line 20 for the automatic assembling of hardwood plywood veneers is illustrated. Assembly line 20 includes a conveyor 22, a number of stations 24, 26, 28, 30, 32, 34, and 36 for placing plies of wood onto the conveyor 22. The assembly line 20 also includes glue spreaders 37, and a stacker 38 at the end of the conveyor 22. The conveyer 22 traverses the ply laying stations 24, 26, 28, 30, 32, 34, and 36 and carries the plies from the ply laying stations to the stacker 38.

Operators at the wood ply depositing stations deposit plies according to a predetermined order that permits hardwood plywood to be manufactured in assembly-line fashion. This reduces the amount of labor and the time it takes to make a unit plywood panels. Additionally, these wood ply depositing stations are coupled to a controller, which is also coupled to the conveyor 22, and the stacker 38 to permit synchronous use to maximize production efficiency.

Operators at the stations depositing plies directly onto the conveyor 22 or onto a ply traveling on the conveyor 22 deposit either a core ply, a center ply, a face ply, or a back ply. In a preferred embodiment, an operator at station 24 deposits center plies directly onto the conveyor 22. Under some circumstances, the operator at station 24 deposits a sheet of press board onto the conveyor for use as a carrier board or a cover board as later described herein.

An operator at station 26 can deposit a core ply either onto a center ply or a sheet of press board used for a carrier board that was deposited by station 24 that is traveling along the conveyor 22.

At station 28, an operator can deposit a ply of face veneer directly onto a core ply that was deposited by station 26 as it travels on the conveyor 22.

An operator at station 30 can deposit a ply of back veneer directly onto the ply of face veneer deposited by station 28 traveling on the conveyor 22.

At station 32, an operator can deposit a core ply directly onto a ply of back veneer that was deposited by station 28.

An operator at station 34 can deposit a center ply directly onto a core ply deposited by station 32 traveling on the conveyor 22.

At station 36, an operator can deposit a core ply directly onto a center ply, deposited by station 34, traveling on the conveyor 22.

The thicknesses and other characteristics of the plies deposited by the stations will vary depending upon the desired characteristics of the plywood to be formed. For example, in one embodiment, the thickness of the cores deposited by stations 26 and 36 can be ⅙ inch while the thickness of the cores deposited by station 32 can be 1/10 inch. In such an arrangement, stations 24 and 34 can deposit centers having a thickness of ⅙ inch.

Figure 2:
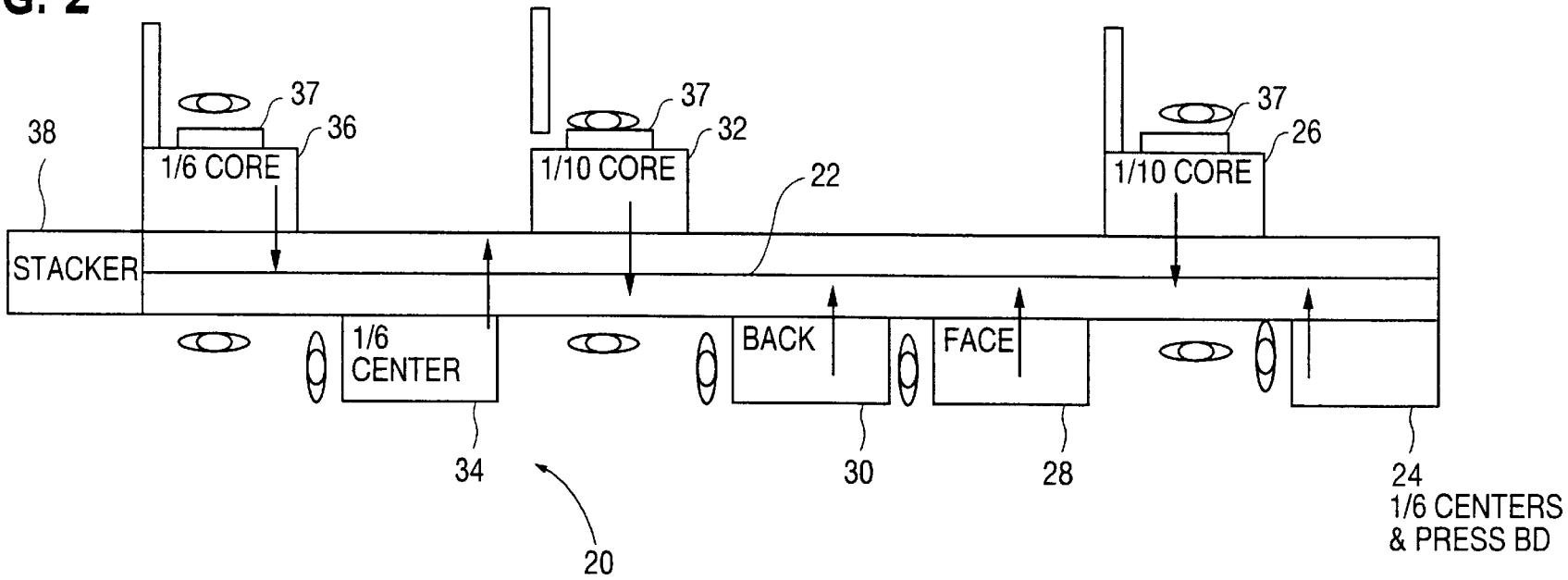
FIG. 2 is a schematic representation of a assembly line and stations for the assembly of plywood panels according to the present invention.
Figure 3:
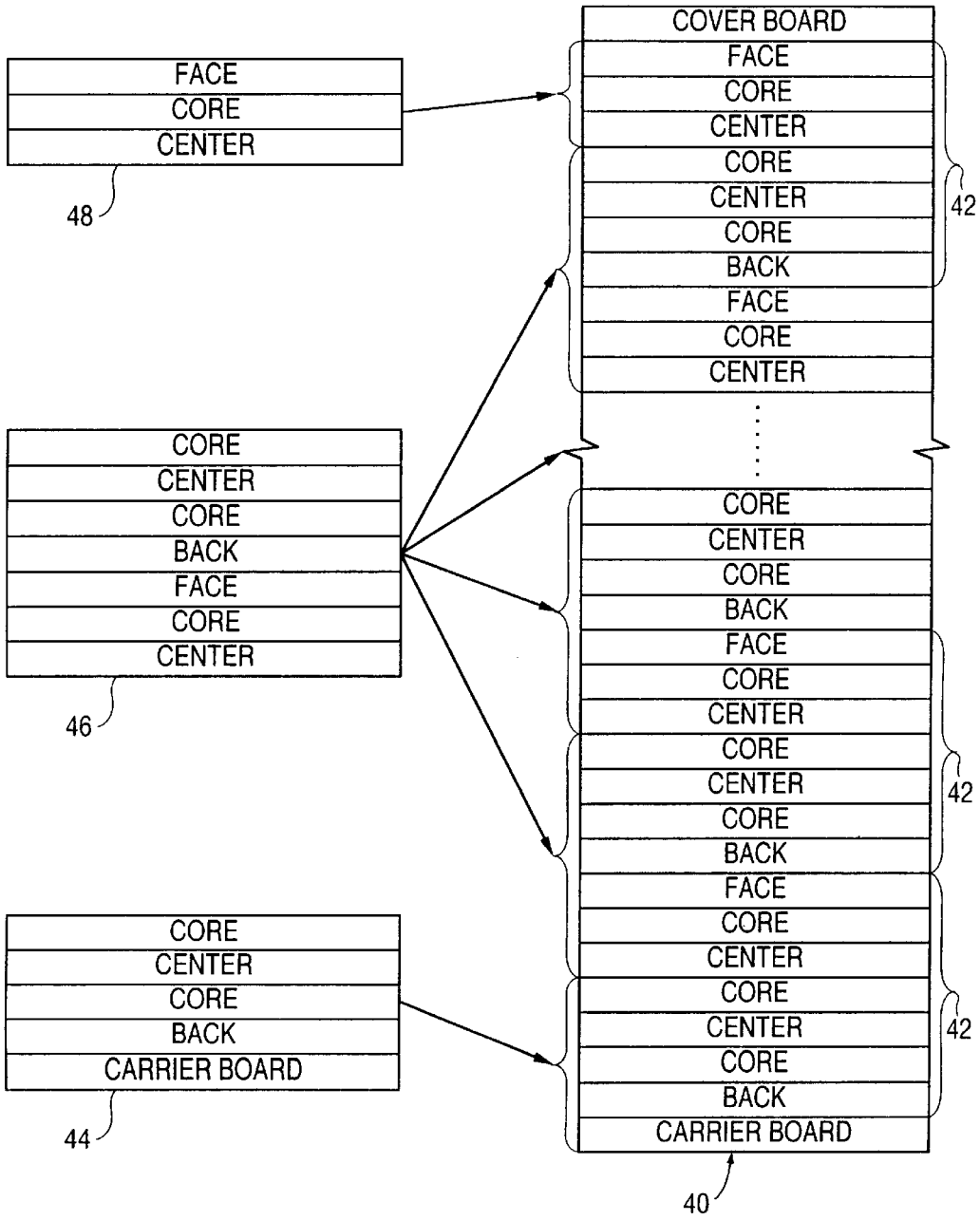
FIG. 3 is a drawing showing an assembled unit of plywood panels and the subunits used in the formation thereof.
Figure 4:
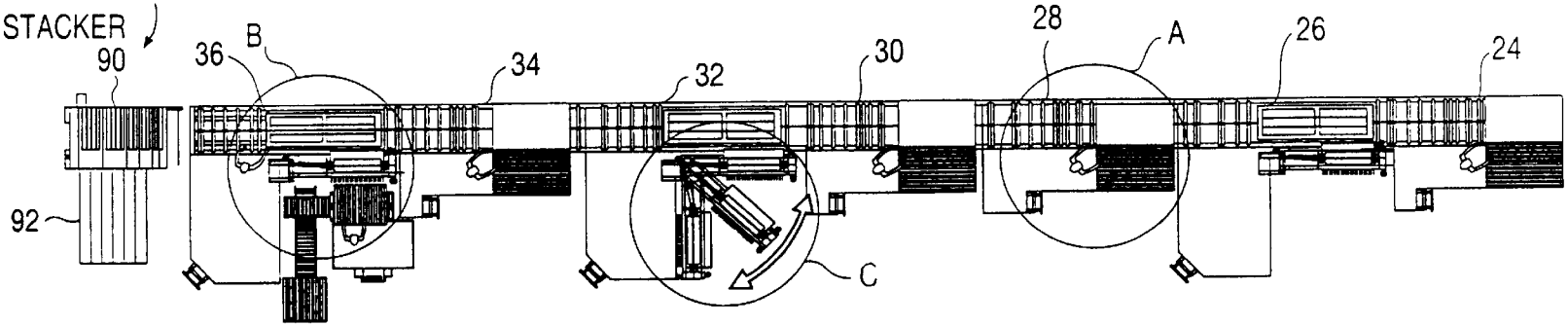
FIG. 4 is a top plan view of the assembly line and stations along the assembly line.

The right hand portion of FIG. 3 depicts a unit 40 of stacked superimposed plies ready to be sent to a prepress and a hot press so that the adhesives can dry and a number of stacked plywood panels 42 will be formed. In the present example, a seven ply plywood panel is used. However, as will be apparent from the description below, this invention can also be used for plywood having other numbers of plies. Further, the present invention describes unit 40 as having thirty plywood panels 42. However, more or less than thirty can be used and the number used will be based on many factors including the number of plies per panel 42 and the size of the presses. The method of assembling a unit 40 is described in conjunction with FIGS. 2 and 3.

The unit 40 is formed by creating a number of subunits 44, 46, and 48 and superimposing a completed subunit on the stacker 38 on the previously created subunit. More specifically, the unit 40 is comprised of a single lower subunit 44, a single upper subunit 48, and many middle subunits 46. The number of middle subunits 46 used will be equal to the number of plywood panels 42 formed by the unit 40 minus one. Each middle subunit 46 forms an upper portion of one panel and a lower portion of another panel. The upper and lower subunits 48 and 44 form the mating pair to the uppermost and lowermost middle subunits 46, respectively.

For each unit 40, the assembly process starts with the assembly of the lower subunit 44 having single carrier board. The middle subunits 46 are assembled on the conveyor line 22. The stacker 38 stacks formed middle subunits 46 on top of the lower subunit 44 and the previously stacked middle subunits 44. The upper subunit 48 is also assembled on the conveyor line 22, and the stacker 38 stacks the formed upper subunits 48 on top of the uppermost middle subunit 46. After this, a single cover board made from press board is deposited on the conveyor 22 by station 24. The cover board is deposited on the face veneer of the upper subunit 48 to complete the unit 40.

More specifically, the first subunit is started with a carrier board which is deposited by an operator directly on the conveyor 22 by station 24 and travels toward the stacker 38. Stations 26 and 28 do not deposit any plies on the carrier board as it moves past. Stations 30, 32, 34, and 36 deposit a ply onto the carrier board and any plies deposited on the carrier board from an upstream station. The completed subunit 44 is moved down the conveyor 22 to the stacker 38.

While portions of the lower subunit 44 are traveling on the conveyor 22 for formation of the lower subunit 44, the middle subunits 46 can start to be formed. The operator at station 24, having access to center plies and press board, deposits a center ply onto the conveyor 22. All of the ply depositing stations 26, 28, 30, 32, 34, and 36 downstream from the first station 24 place a superimposed ply on the center ply for the first station 24, and any plies deposited on that center ply from an upstream station. The completed middle subunit 46 is moved to the stacker 38 where the formed middle unit 46 is stacked upon the lower subunit 44. Additional middle subunits 46 can be formed while the prior middle subunits 46 are being formed due to the assembly line configuration.

The upper subunit 48 begins to be formed after the last of the predetermined number of middle subunits 46 starts to be formed. The upper subunit 48 is formed by station 24 depositing a center ply onto the conveyor 22. Stations 26 places a core ply on the center ply in a superimposed relationship. Stations 28 deposits a ply of face veneer directly on the core ply, which is above the center ply. This completes the upper subunit 48. Subunit 48 travels past stations 30, 32, 34, and 36 without the addition of another ply. The completed upper subunit 48 is moved to the stacker 38 where it is stacked upon the uppermost middle subunit 46. A sheet of press board acting as a cover board is deposited onto the conveyor 22 by the operator at station 24, after the operator deposits the center ply for the upper subunit 48. This cover board travels down the conveyor 22 to the stacker and is placed on top of the upper subunit 48.

During this process, glue is deposited to both sides of each core panel. As can be seen in FIG. 3, this provides adhesive between each ply of each panel 42 to be formed. Thus, when the unit 40 is processed in a conventional manner, i.e., by prepress and by hot press, distinct complete stacked sheets of plywood are formed.

Further, each subunit 44, 46, 48 starts with a center ply or a sheet of press board. The center plies are typically the most durable plies used in the panels and scratches, stains, and other imperfections caused by these panels coming in contact with the conveyor 22 will not affect the quality of the hardwood plywood panels. The press board sheets used as the carrier and cover boards are scrap boards and are not part of the finished panels. Compared to the existing process where it takes approximately 10–15 minutes to assemble a unit of 30 7-ply hardwood panels, this process can assemble a unit of 30 7-ply hardwood panels in approximately 3 minutes.

While one of ordinary skill in the art will recognize that the conveyor and the stations can be designed in various way to perform the above-describe process, details of a preferred embodiment are included below. The conveyor 22 includes a horizontal portion, shown in FIGS. 8–11, for providing a force to move the plies along the conveyor, and a vertical portion, shown in FIGS. 12–14, for guiding the edge of the plies and ensuring that the plies are perfectly superimposed above one another.

The horizontal portion includes an endless chain 50 arranged substantially horizontal. Horizontal flights 51 are coupled transversely to the chain 50 at spaced longitudinal intervals by any conventional method. The flights 51 can be spaced to provide a visual indicator to operators regarding the desired positioning of the plies with respect to the chain. Guide rails 52 are positioned on each side of the chain 50. Guide rails 52 are parallel to the chain 50 and to each other. The guide rails 52 are spaced from the chain 50 to support the undersides of the flights 51 in sliding, load bearing engagement. The flights 51 and guides 52 can optionally be covered with a low friction material, such as an ultra-high molecular weight plastic, to decrease wear and extend the life of these elements. Certain flights 51 have upstanding supports or "dogs" 54 attached to their leading edge. This provides a square leading surface to align the layers of veneer. At appropriate intervals, spurs 56 are attached to selected flights 51 to hold the undersides of the veneer in place throughout their travel along the line and to ensure that they will not slip.

Figure 12:
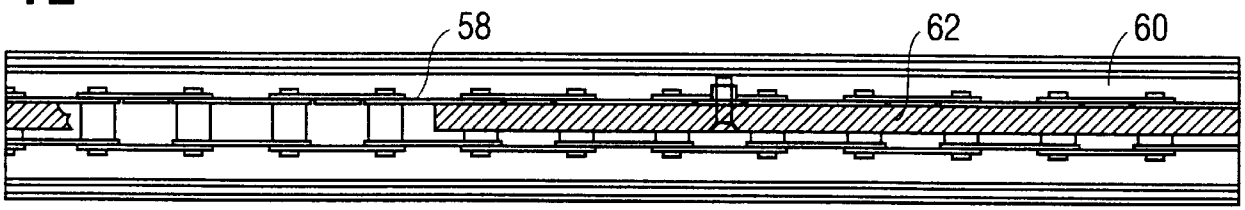
FIG. 12 is a top plan view of the vertical or backboard portion of the conveyor.
Figure 13:
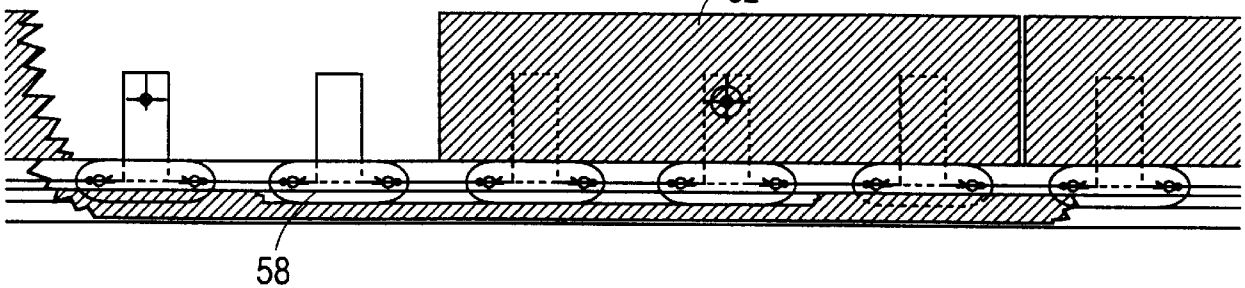
FIG. 13 is a side elevational view of the vertical or backboard portion of the conveyor.
Figure 14:
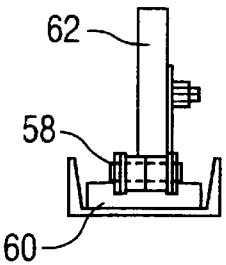
FIG. 14 is an end view of the vertical or backboard portion of the conveyor.

On one side of the frame, the vertical portion of the conveyor serves as an alignment tool. As shown in FIGS. 12–14, this vertical portion serves as a backboard and includes a chain 58 that runs in a guide parallel to the chain 50 of the horizontal portion. This chain 58 is preferably a multi-linked chain having ultra-high molecular weight plastic guiding components 62 that form a wall or fence that travels at the same speed as the flight chain 50 and provides a solid point to build plywood against. A suitable variable speed drive is connected to both of the chains 50 and 58 for driving them at a predetermined linear speed. This arrangement permits the conveyor 22 to move the sheets past the various stations at a uniform production rate and maintain the proper alignment of the sheets.

It may also be desirable to employ an air jet devices 64 associated with the conveyer 22 for removing debris from the upper surfaces of the sheets so that other sheets may be overlaid effectively. In assembly of plywood veneers, this is of particular importance because, in spite of all precautions, operation of the conveyer loosens knots and slivers, creating debris. If debris is permitted to remain on the upper surface of an underlying veneer, it will cause a domino effect and interfere with the proper positioning at subsequent stations of underlying veneer. This will cause the production of panels that are rejected as a result of the debris being pressed into the veneers in the plywood press. Air jet devices 64 may, for example, be placed along selected stretches of the conveyer such as between stations 24 and 26, stations 28 and 30, and/or stations 34 and 36.

Figure 15:
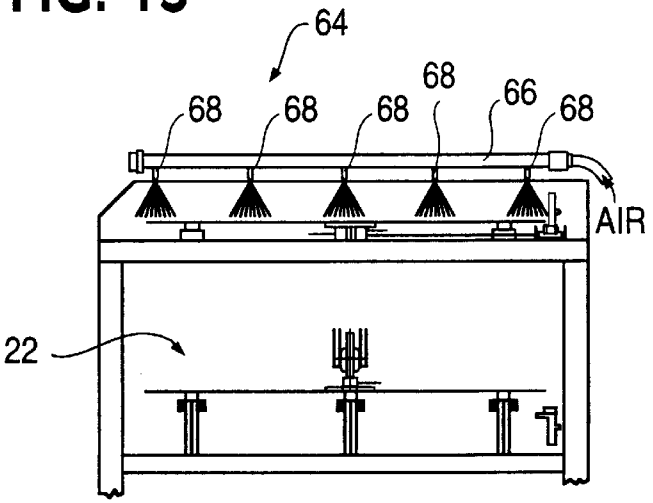
FIG. 15 is a side elevational view of the air jet device.
Figure 16:
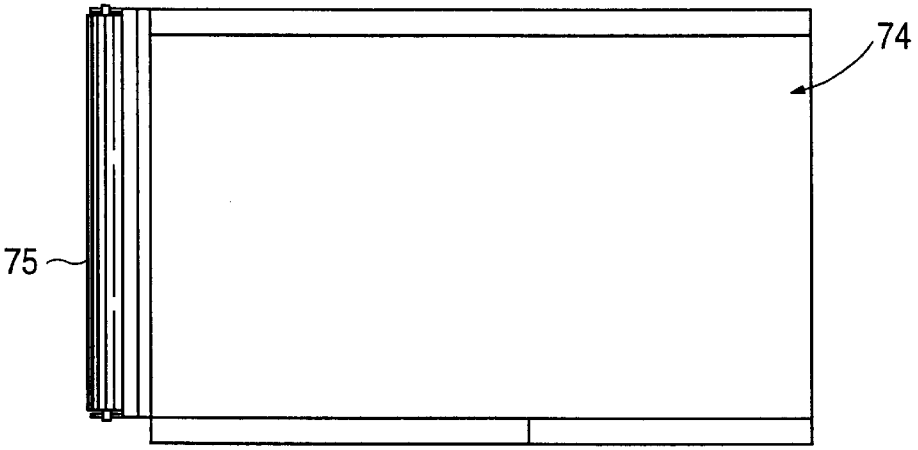
FIG. 16 is a top view of the inclined sheet shear.
Figure 17:
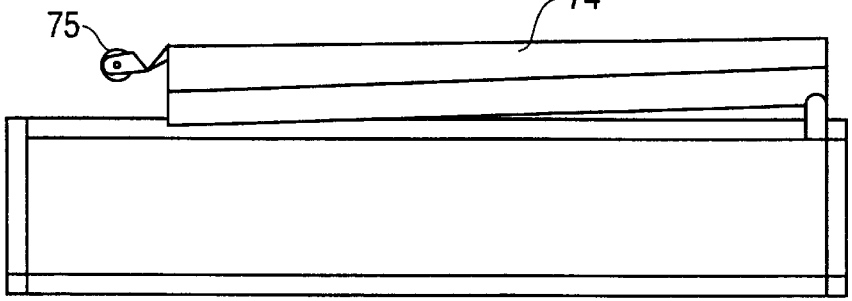
FIG. 17 is a side view of the inclined sheet shear.

One example of air jet device 64, which is also referred to as an air knife, is shown in FIG. 15. Thus it may include a manifold 66 extending above the conveyor 22 fitted with a plurality of spaced airjet heads 68. The heads 68 are directed down against the upper surfaces of the oncoming sheets at a predetermined angle. The manifold 66 is supplied with compressed air from a suitable source, not shown. This removes debris from the veneer and holds down the layer of veneer. Thus, the result is the disbursement of the debris from the sheets, without disturbing the position of the sheets.

Figure 5:
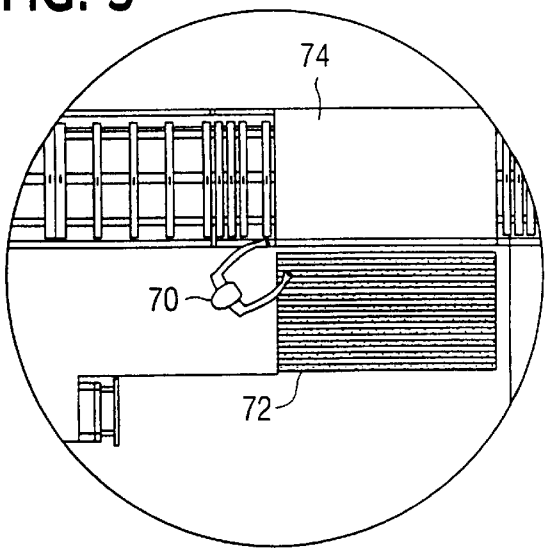
FIG. 5 is an enlarged view of region A of FIG. 4.

Additional details relating to the ply laying stations 24, 26, 28, 30, 32, 34, and 36 and the glue spreaders 37 are provided below. Face veneer, back veneer and center ply laying stations 24, 28, 30, and 34 are basically similar in structure but may be adjusted to accommodate the different plies to be deposited therefrom. An example of this type of station is shown in detail in FIG. 5. At these locations, an operator 70 takes a ply of wood from a stack 72 which can be on a scissor lift and moves it transversely onto an inclined sheet shear 74 above the conveyor 22. The type of ply transferred will depend upon the station. For example, the type of board will be either a press board or center ply at station 24, a face veneer at station 28, a back veneer at station 30, or a center ply at station 34. The operator 70 then moves the particular ply over a roller 75 near the end of the sheet shear 74 and onto the conveyor 22 at the proper time, ensuring that the ply is placed squarely against the dogs 54 and the vertical guides 62. The roller 75 reduces drag and allows a smooth, undisturbed positioning of the veneer plies on the underlying veneer already on the conveyor 22. As the conveyor 22 moves, the ply is taken away from the sheet shear 74. The ply may pass underneath an air knife 64 to remove debris. The starting and stopping of the plies is queued by a timing light at one or a plurality of stations in order to keep the panel construction sequence correct. At station 24, a counter can be mounted in view of the operator of the station for controlling the sequence.

Figure 6:
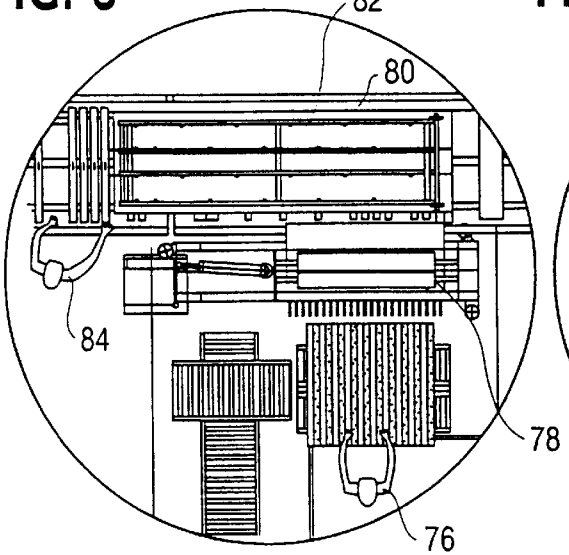
FIG. 6 is an enlarged view of region B of FIG. 4.
Figure 8:
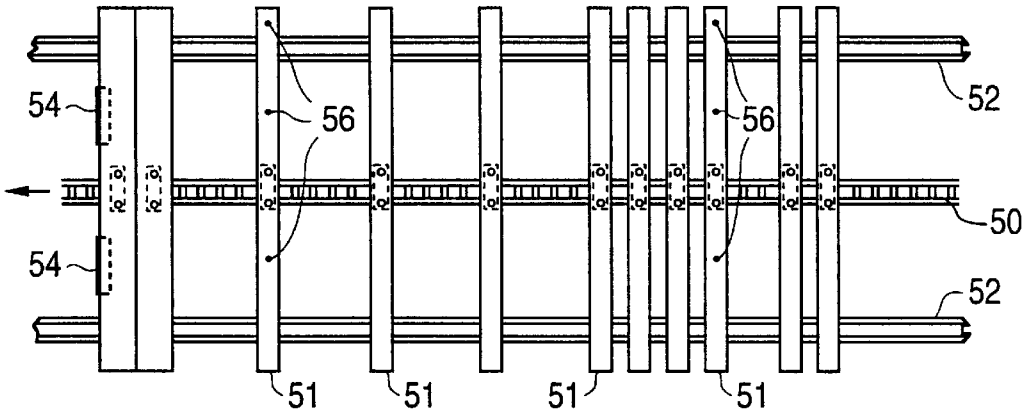
FIG. 8 is a top plan view of the horizontal portion of the conveyor.
Figure 9:
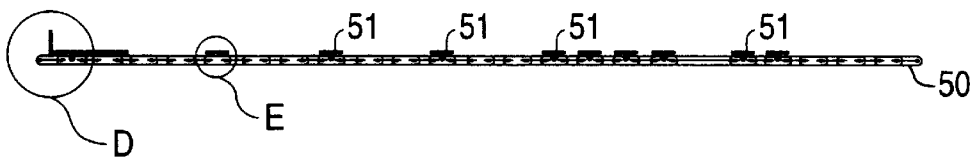
FIG. 9 is a side elevational view of the horizontal portion of the conveyor.
Figure 10:
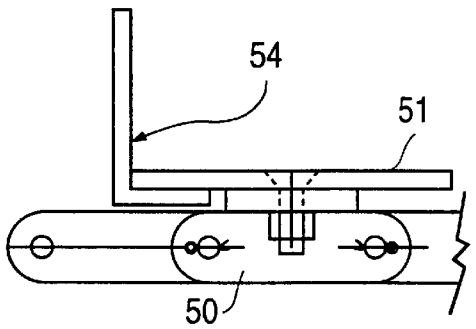
FIG. 10 is an enlarged view of region D of FIG. 9.
Figure 11:
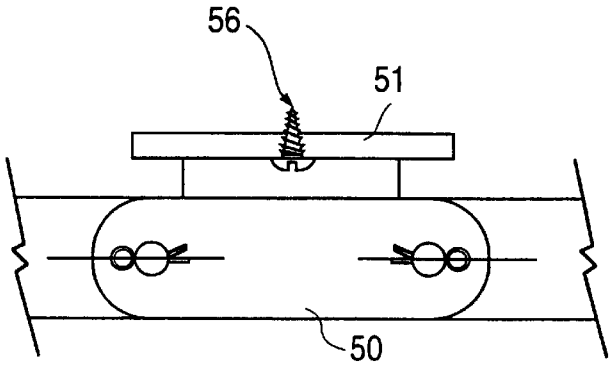
FIG. 11 is an enlarged view of region E of FIG. 9.

Stations 26, 32, and 36 are similar in structure and are shown in detail in FIG. 6. At these stations, another operator 76 feeds core veneers into the pinch rollers of an industry standard glue spreader 37. At these glue spreaders 37, the core veneers are coated on both sides with an adhesive. One preferred glue spreader is a five foot spreader made by Globe.

When the core veneers exit from the glue spreader 37, they strike a spring loaded stop 80 and fall onto a set of power driven belts 82. The belts 82 move the core ply to the mesh point for an operator 84 who moves the core ply onto the top ply on the conveyor. The operator 84 then ensures that the ply is placed squarely against the dogs 54 and the vertical guides 62. Typically, there will be two pieces of wood making up the core ply due to the transverse orientation of the grain of the core ply, relative to the other plies, and the typical sizes of such pieces. The second piece is placed downstream from the first piece, in an abutting relationship therewith. The speed of the belts 82 is controlled by the operator 84 who may be queued by a timing light when to start and stop in order to keep the panel construction sequence correct.

Figure 7:
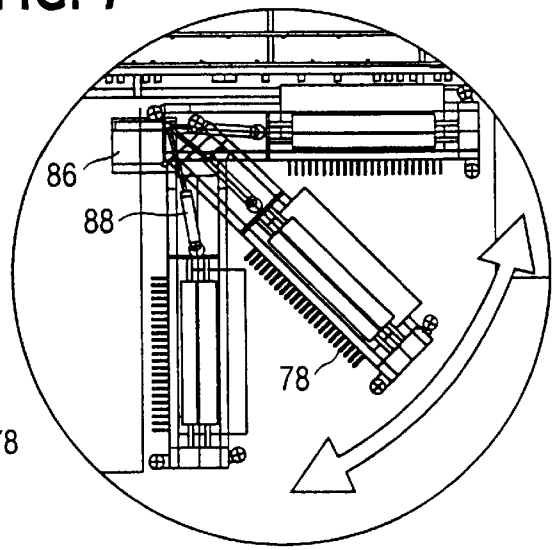
FIG. 7 is an enlarged view of region C of FIG. 4.

As shown in FIG. 7, the glue spreaders 37 may be pivotally mounted to a frame 86. A hydraulic cylinder 88 can be actuated to move the spreader 37 from its in-use position parallel to the conveyor 22 and a cleaning and maintenance position perpendicular to the conveyor 22. This facilitates the cleaning and maintenance of the spreaders 37.

The stacker 38 is positioned at the end of the conveyor 22. Any device known in the art can be used for transporting the completed subunits from the end of the conveyor at accumulator rollers 90 to a hoist. Such devices include side shift accumulators known in the art and manufactured by Kenton and Spartex. When a side shift accumulator is used, each completed subunit reaching the far end of the accumulator rollers 90 actuates a switch which moves the accumulator arms. These arms are spaced and interposed between the accumulator rollers. The arms move up through the rollers, picking up and transporting a completed subunit to the accumulator hoist 92. The completed subunit can be positioned directly onto the hoist 92 or onto a completed subunit previously placed on the hoist 92 in any desired manner. For example, the edge of the completed subunit can be placed against a vertical wall and the arms can travel in a cyclical pattern so they move essentially horizontally away from the hoist after transporting the subunit thereto. In this instance, the completed subunit is at least partially removed from the arms by friction. As the arms move back toward the conveyor, they are positioned beneath and in between the rollers to receive another subunit at the rollers, leaving the subunit it was carrying on the hoist 92. This keeps repeating until the preset number of subunits are on the hoist 92, then the hoist 92 drops and discharges the completed unit. While the hoist 92 discharges the unit of panels, a set of secondary arms may be utilized to extend out over the hoist area and support the first few subunits of the new unit until the hoist 92 arrives back in position to receive them. The discharged unit of panels moves automatically into the prepress system.

The prepress, not shown, is automatically time controlled. It receives the units from the accumulator hoist and after a preset time period, for example three minutes, is subjected to 175 psi pressure for another preset time period, for example five minutes. After this period, the press opens and discharges its load for travel to the hot press. After being transferred to the hot press, heat is applied to the units in a well known manner and for a known period of time. At the end of the application of the hot press, 30 stacked sheets of hardwood plywood have been formed.

The above discussed assembly line is configured to produce hardwood plywood having from three to seven plies, a standard number of plies in the industry. However, it is contemplated that the assembly line could be modified to produce hardwood plywood having more than seven plies. For instance, the assembly line could be lengthened to produce nine-ply sheets. The additional stations would include a center ply laying station and a core ply laying station, both positioned after station 36. By lengthening the line and adding stations, a plywood panel having a number of plies that corresponds to the number of stations can be produced. Like the stations described above, the actions of the stations of the lengthened assembly line can be synchronized.

Additionally, the assembly line according to the present invention can be used with other types of plywood that require an aesthetically pleasing face or back veneer. It can also be used to assemble plywood having an outer surface that is sensitive to marring, such as a sheet of plywood requiring smooth, planar face and back veneers, but not sensitive to its aesthetic appearance. As discussed above, the present invention produces sheets of plywood without damaging its exposed veneers.

While particular embodiments of the invention have been shown and described, it is recognized that various modifications thereof will occur to those skilled in the art. Therefore, the scope of the herein-described invention shall be limited solely by the claims appended hereto.

What is claimed is:

1. A method for making hardwood plywood panels, each having at least one outer hardwood veneer with a thickness no greater than 1/28 inch, said method comprising the steps of:

providing a conveyor having a length;

providing a plurality of ply depositing stations longitudinally spaced along the length of the conveyor;

sequentially depositing a plurality of plies from the ply depositing stations on the conveyor in a superimposed relationship to form discrete subunits;

stacking a plurality of subunits in a superimposed relationship to form a unit; and processing the unit to form stacked discrete hardwood plywood panels.

2. The method as claimed in claim 1, wherein said sequentially depositing step includes depositing a number of plies in a discrete subunit equal to the number of plies in the hardwood plywood panels formed.

3. The method as claimed in claim 2, wherein said sequentially depositing step includes depositing the number of plies in said discrete subunit in a different order than that of the order of plies in the hardwood plywood panels formed.

4. The method as claimed in claim 1, further comprising the step of stacking a first discrete subunit directly onto a second subunit, the first subunit having the same number and order of plies as the second subunit.

5. The method as claimed in claim 1, further comprising the step of stacking a first discrete subunit directly onto a second subunit, the first subunit having a different number of plies than the second subunit.

6. The method as claimed in claim 1, wherein said hardwood plywood panels include outer veneers, the sequentially depositing step includes superimposing all outer veneers directly upon other wood elements such that no outer veneer directly touches the conveyor.

7. The method as claimed in claim 1, wherein the sequentially depositing step includes depositing back veneers, face veneers, core plies, and center plies, said method further comprising the step of placing a carrier board directly onto the conveyor and placing a back veneer directly onto the carrier board.

8. A method of making a unit of wood plies to be subsequently processed for forming a plurality of discrete plywood panels, each panel having a face veneer, a back veneer, at least one center ply, and at least one core ply, the method comprising the steps of:

forming a first subunit of plies;

forming a plurality of discrete second subunits of plies, each said second unit of plies differing from the first subunit; and stacking a formed second subunit on a formed first subunit.

9. The method as claimed in claim 8, further comprising the step of forming a third subunit of plies, said third subunit of plies differing from the first and second subunits; and stacking a formed third subunit on a formed second subunit.

10. The method as claimed in claim 8, further comprising the step of repeatedly stacking a formed second subunit directly on top of another formed second subunit.

11. The method as claimed in claim 10, further comprising the step of forming a third subunit of plies, said third subunit of plies differing from the first and second subunits; and stacking a formed third subunit directly on a second subunit stacked, that has been stacked upon another second subunit.

12. The method as claimed in claim 8, wherein said step of forming a second subunit of plies includes superimposing a back veneer directly on top of a face veneer.

13. The method as claimed in claim 8, wherein said step of forming a second subunit of plies includes superimposing a plurality of plies equal to the number of plies in each of the plywood panels to be formed.

14. The method as claimed in claim 13, wherein said step of forming a second subunit of plies includes superimposing a plurality of plies in an order different than the order of the plies in each of the plywood panels to be formed.

15. The method as claimed in claim 8, wherein said step of forming a first subunit includes superimposing a back veneer directly on top of a carrier board.

16. The method as claimed in claim 8, wherein step of forming a first subunit of plies, and said step of forming a plurality of discrete second subunits of plies are performed simultaneously.

17. A method of making a unit of wood plies to be subsequently processed for forming a plurality of discrete hardwood plywood panels, each panel having a face veneer, a back veneer, at least one center ply, and at least one core ply, the method comprising the steps of:

forming a plurality of subunits, and stacking formed subunits on top of other subunits in a superimposed relationship, wherein at least one of the discrete subunits is formed by the steps of:

stacking a face veneer on top of one core ply, stacking a back veneer on top of the face veneer, and stacking a second core ply on top of the back veneer.

18. The method as claimed in claim 17, wherein said forming steps of at least one subunit includes placing a center ply directly on a conveyor as a first ply in said at least one subunit.

19. The method as claimed in claim 18, wherein said forming of a plurality of subunits step includes forming a first subunit type and forming a second subunit type, said second subunit type being formed differently from the first subunit type.

20. The method as claimed in claim 19, wherein said forming of a plurality of subunits step further includes forming a third subunit type, said third subunit type being formed differently from the first and second subunit types.

* * * * *